United States Patent [19]

Beckey

[11] Patent Number: 4,735,054

[45] Date of Patent: Apr. 5, 1988

[54] METHOD FOR MINIMIZING OFF CYCLE LOSSES OF A REFRIGERATION SYSTEM DURING A COOLING MODE OF OPERATION AND AN APPARATUS USING THE METHOD

[75] Inventor: Thomas J. Beckey, Edina, Minn.

[73] Assignee: Honeywell Inc., Minneapolis, Minn.

[21] Appl. No.: 85,038

[22] Filed: Aug. 13, 1987

[51] Int. Cl.[4] ..... F25D 17/06; F25B 49/00

[52] U.S. Cl. ..... 62/93; 62/176.1; 62/231

[58] Field of Search ..... 62/93, 176.5, 176.1, 62/176.6, 180, 186, 232

[56] References Cited

U.S. PATENT DOCUMENTS 2,214,057 9/1940 Hull ..... 62/176.5

FOREIGN PATENT DOCUMENTS 2413618 9/1975 Fed. Rep. of Germany ..... 62/93

452765 8/1936 United Kingdom ..... 62/176.1

*Primary Examiner*—William E. Wayner

*Attorney, Agent, or Firm*—Mitchell J. Halista; Albin Medved

[57] ABSTRACT

A refrigeration system control method and apparatus for minimizing off cycle losses during a cooling mode of operation of a refrigeration system having an indoor coil, an indoor coil fan, an outdoor coil, an outdoor coil fan, a refrigerant line between one end of the indoor coil and one end of the outdoor coil, a valve in the refrigerant line and a compressor apparatus connecting the other end of the indoor coil to the other end of the outdoor coil includes the steps of sensing the humidity of an indoor space to be cooled by the refrigeration system to determine whether the sensed humidity is below a preset humidity setpoint level or above the preset humidity level, and controlling an energization of an indoor coil fan during a time period starting with an energization of the compressor apparatus and ending after the deenergization of the compressor apparatus and having a fan energization duration during the time period dependent on the sensed humidity.

8 Claims, 2 Drawing Sheets

METHOD FOR MINIMIZING OFF CYCLE LOSSES OF A REFRIGERATION SYSTEM DURING A COOLING MODE OF OPERATION AND AN APPARATUS USING THE METHOD

CROSS-REFERENCE TO CO-PENDING APPLICATION

Subject matter shown but not claimed herein is shown and claimed in a co-pending application of T. J. Beckey and Lorne W. Nelson, Ser. No. 050,270, filed on May 15, 1987.

BACKGROUND OF THE INVENTION

1. Field of the Invention

The present invention relates to a refrigeration system. More specifically, the present invention is directed to a control method for a refrigeration system for minimizing off cycle losses while maintaining a desired humidity level and an apparatus using the method.

SUMMARY OF THE INVENTION

An object of the present invention is to provide an improved refrigeration system control method to minimize off cycle losses while maintaining a desired humidity level.

Another object of the present invention is to provide an improved refrigeration system utilzing the improved control method.

In accomplishing these and other objects, there has been provided, in accordance with the present invention a method for controlling a refrigeration system during a cooling mode of operation having an indoor coil, an indoor coil fan, an outdoor coil, an outdoor coil fan, a refrigerant line between one end of the indoor coil and one end of the outdoor coil and a compressor means connecting the other end of the indoor coil to the other end of the outdoor coil including the steps of sensing the humidity of an indoor space to be cooled by the refrigeration system, and controlling an energization of the indoor coil fan during a time period starting with an energization of the compressor means and ending after the deenergization of the compressor means and having a fan energization duration during the time period dependent on the sensed humidity. An apparatus utilizing this method in a refrigeration system in a cooling mode of operation comprises an indoor coil, an indoor coil fan, an outdoor coil, an outdoor coil fan, a refrigerant line connecting one end of the indoor coil to one end of the outdoor coil, compressor means connecting the other end of the indoor coil to the other end of the outdoor coil, a humidity sensor means for sensing the humidity of an indoor space and controller means for operating the indoor fan, the outdoor fan and the compressor in response to an output signal from the humidity sensor to maintain control of an energization of the indoor fan starting with an energization of the compressor means and ending after a deenergization of the compressor means and having a fan energization duration during the time period dependent on the sensed humidity to maintain an acceptable humidity level.

BRIEF DESCRIPTION OF THE DRAWING

A better understanding of the present invention may be had when the following detailed description is read in connection with the accompanying drawings in which.

DESCRIPTION OF THE PREFERRED EMBODIMENT

Figure 1:
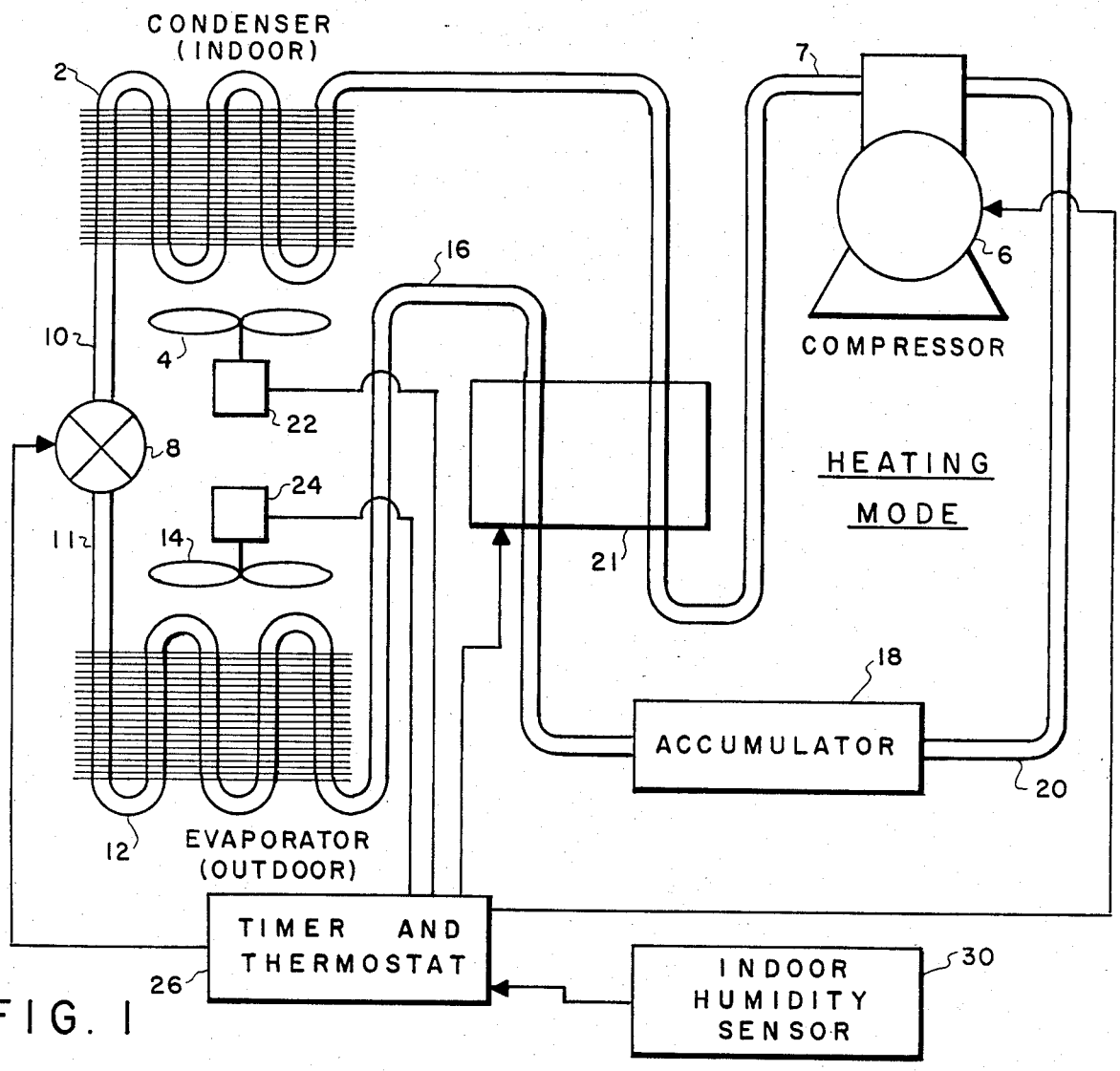
FIG. 1 is a simplified pictorial illustration of a refrigeration system in a heating mode and incorporating an example of the present invention and FIG. 2 is a timing diagram illustrating the operation of the refrigeration system shown in FIG. 1.

Referring to FIG. 1 in more detail, there is shown a simplified pictorial illustration of a refrigeration system arranged in a heating mode having an indoor coil identified as a condenser coil 2 and an indoor coil fan 4. These elements are conventionally referred to as indoor elements inasmuch as they are located within the enclosure or space to be heated by the flow of indoor air over the condenser 2 during heating mode of operation. In a cooling mode of operation, the flow of refrigerant is reversed by a four way reversing valve as described hereinafter, and the indoor coil unit is used as an evaporator coil to cool the flow of air within the conditioned space or enclosure. The outdoor coil would concurrently function as a condenser coil. The present invention is applicable primarily to the cooling mode of operation to recover the latent energy stored in the indoor coil while maintaining the humidity of an indoor conditioned space within acceptable limits. An apparatus utilizing both types of operation with a reversing valve to selectively switch from one mode of operation to the other is conventionally designated as a heat pump, e.g., the system shown in U.S. Pat. No. 3,115,018. A compressor 6 is used to supply a compressed refrigerant along a first refrigerant line 7 to an inlet of the condenser 2. An electrically operated tight shutoff valve 8 in a second refrigerant line 10 connected to the outlet of the condenser 2 is used to control the flow of refrigerant from the condenser 2. The outlet from the valve 8 is connected through a third line 11 to an inlet of an outdoor coil 12 having a fan 14 associated therewith. Since these elements are arranged externally of the enclosure to be heated during the heating mode of operation they are referred to as outdoor elements.

Figure 2:
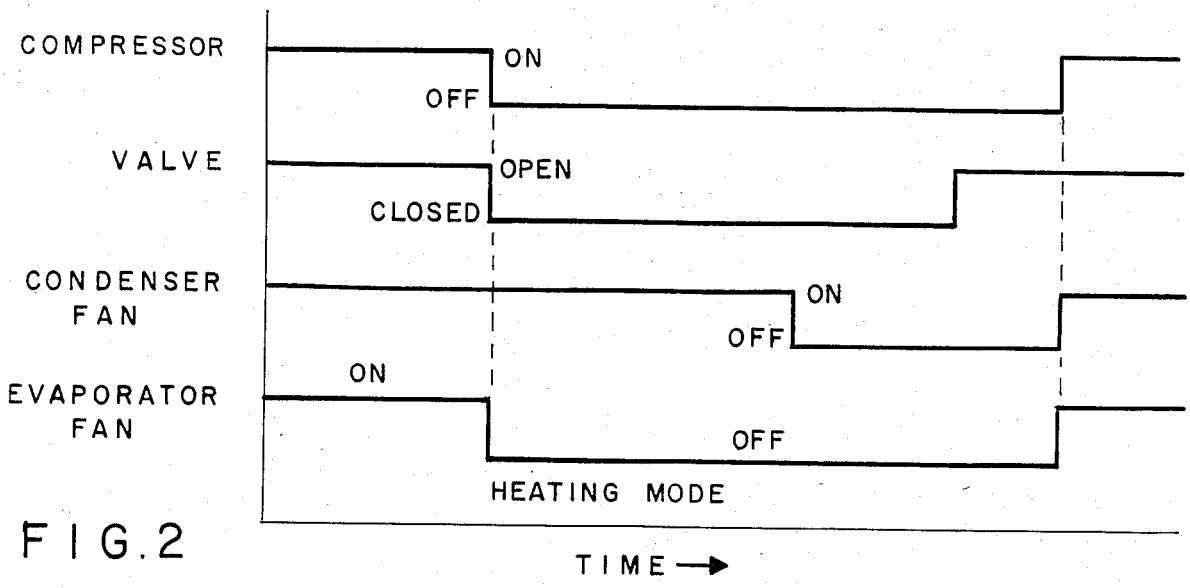
Figure 3:
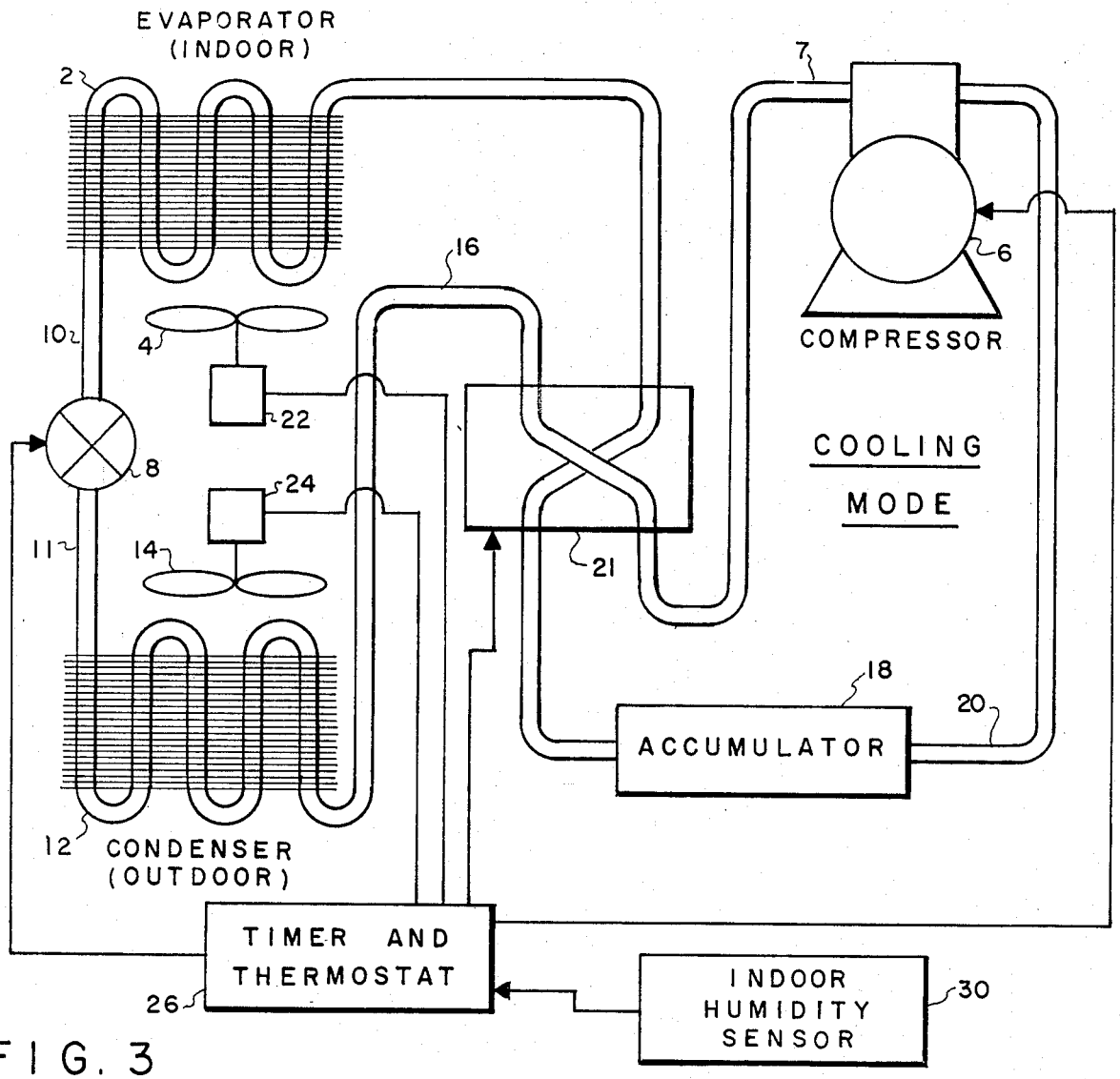
FIG. 3 is a simplified pictorial illustration of the refrigeration system shown in FIG. 1 in a cooling mode utilizing the present invention and FIG. 4 is a timing diagram illustrating an operation of the refrigeration system shown in FIG. 3 for a low humidity condition.

The output from the evaporator 12 is connected through a fourth line 16 to an input of a refrigerant accumulator 18. An output from the accumulator 18 is connected through a fifth line 20 to the inlet of the compressor 6. A four way reversing valve 21 is arranged in the flow lines 7 and 16 to change the refrigerant flow between the heating and cooling modes as shown in FIGS. 1 and 3, respectively. The operation of such reversing valves is well-known in the art as discussed in the aforesaid patent and basically provides a reversal of the functions of the indoor and outdoor coils 2,12 to provide the heating and cooling modes. A motor 22 for the condenser fan 4, a motor 24 for the evaporator fan 14, the valve 8 and the compressor 6 are operated in a sequential pattern as illustrated in FIG. 2 by a timer and thermostat controller 26. While such multiple time sequence timers are well-known in the art, the timing sequences illustrated in FIGS. 2 and 4 to achieve the novel method of the present invention can also be obtained from a microprocessor operated according to a fixed program stored in a memory. The operation of a microprocessor and the storage of a program to operate a microprocessor are well-known operations to one skilled in the art and require no further explanation for a complete understanding of the present invention. An indoor humidity sensor 30 is used to sense the humidity of an indoor conditioned space and to provide an output signal to the controller 26 representative of the deviation of the sensed humidity from a desired or setpoint humidity selected by an occupant of the indoor space. The humidity sensor 30 can include an analog-to-digital converter to provide digital signal to the microprocessor in the controller 26. Additionally, the sensor 30 can include a comparator for comparing a sensed humidity with a humidity setpoint to provide a deviation output signal to the controller 26. Since in the heating mode the output signal from the humidity sensor is disregarded by the controller 26, the following description of the heating mode of operation does not refer to the humidity sensor 30. During the cooling mode of operation, the output of the humidity sensor 30 is used by the controller 26 to control the start and stop times of the indoor fan 4 as described hereinafter.

During steady state operation in the heating mode, most of the system's refrigerant resides in the condenser 2 and line 10 as a hot liquid. Since the valves ordinarily used in the refrigeration system do not shut tightly when the compressor is turned off, the refrigerant will migrate from the condenser and line 10 to the evaporator. The heat energy in the refrigerant is, consequently, lost to the outdoor air by means of the evaporator coil. Also, the energy stored in the mass of the hot condenser coil may be lost if the condenser coil is located in an unconditioned space. Further, because the excess refrigerant in the evaporator has to be pumped back into the condenser when the compressor starts, the time to reach steady state is increased. Both of these effects result in a degradation of the cyclic coefficient of performance (COP) of the system.

In order to minimize such losses, the system shown in FIG. 1 is arranged to close the valve 8 immediately after the compressor 6 is turned off to provide a tight shut off of line 10 in order to contain the hot liquid refrigerant in the condenser or indoor coil 2 and line 10. Concurrently, the indoor fan 4 is allowed to continue running for a predetermined first period of time as determined by the timer 26 to capture the heat energy stored in the hot coil and refrigerant of the condenser. At the end of the first time period, the fan for the condenser 2 is turned off. After a second time period which is prior to the next turn-on of the compressor, the valve 8 is opened, and the refrigerant is allowed to equalize pressures in the condensor 2 and outdoor coil 12 for a specified time. Thus, the present system recovers the heat energy of the hot coil and refrigerant into the interior space being heated and equalizes the refrigerant pressure before starting the compressor to eliminate the need for a so-called "hard start kit". It should be noted that as previously stated the timing function provided by the timer and thermostat controller 26 may be effected by a suitable program in a microprocessor which is used to control the refrigeration system.

Figure 4:
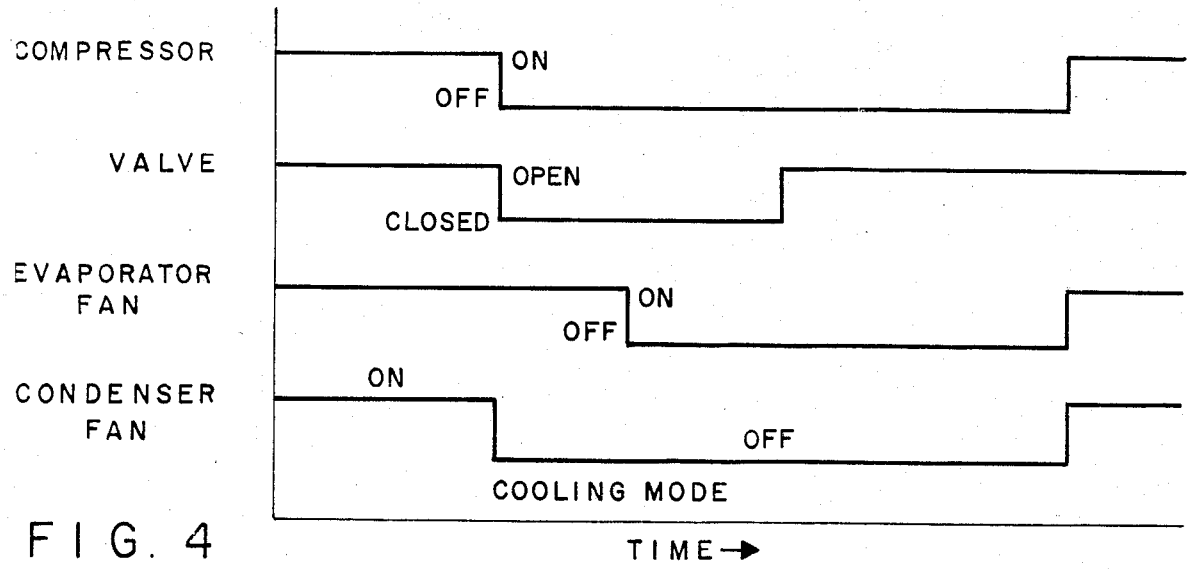

As previously stated, the present invention is applicable to a cooling mode of operation as shown in FIG. 3 in which the reversing valve 21 is operated, and indoor coil 2 functions as an evaporator to cool the indoor air. Also, in the cooling mode, the designations of evaporator and condenser used in the timing diagram of FIG. 2 would be reversed as shown in FIG. 4. The present invention is effective to enhance this cooling function by controlling the duration of the operation of the indoor fan 4 in combination with the operation of the compressor 6. Specifically, in order to maintain a desired humidity level in the space being cooled by the heat pump in the cooling mode, the duration of the operation of the indoor fan 4 during the cooling mode is controlled in the present invention by the output signal from the indoor humidity sensor 30 wherein the on-time of the indoor fan 4 is dependent on the sensed humidity of the conditioned space. Thus, in the cooling mode, the energization of indoor fan motor 22 is controlled as a function of the sensed indoor humidity, i.e., the turn-on of fan motor 22 can be delayed after the compressor 6 is started and the turn-off of the fan motor 22 can be delayed until after the compressor 6 is stopped. The purpose of variations in the duration of the on-time of the indoor fan 4 is to provide an improved comfort control during the cooling mode since the dry-bulb temperature as set on the thermostat 26 and the humidity setpoint level as set on the humidity sensor 30 affect the comfort conditions with the cooled space.

In operation, the humidity setpoint would be set on the humidity sensor 30 by an occupant of the cooled space in conjunction with a setting of a dry-bulb temperature on the timer and thermostat controller 26. The controller 26 would turn the compressor 26 on and off to achieve the dry-bulb temperature setpoint. The controller would also operate the indoor fan 4 in response to an output signal from the humidity sensor 30 in order to try to maintain the humidity level at or below the setpoint as set on the humidity sensor 30. If the sensed humidity is above its setpoint, the controller would delay the turn-on of the indoor fan 4 until the end of a predetermined time after the turn-on of the compressor 6 to allow the indoor coil 2 to be cold enough to start removing moisture from the air moving across the coil 2 immediately with the delayed turn-on of the fan 4 rather than after a time as in the case when the indoor fan motor 22 is energized concurrently with the compressor 6 to enhance the quantity of moisture removed from the air in the conditioned space. The fan 4 would subsequently be turned off concurrently with the deenergization of the compressor 6.

On the other hand, if the humidity falls below the humidity setpoint, the controller 26 would allow the indoor fan motor 22 to be energized concurrently with the compressor 6 and to be deenergized after the compressor 6 is deenergized after a period of time which is dependent on the humidity sensed by the humidity sensor 30, as shown in FIG. 4. This delayed turn-off of the indoor fan 4 allows moisture on the indoor coil 2 to re-evaporate. This reevaporation will increase the humidity level within the conditioned space, but still below the humidity setpoint. Such a delay in turn-off of the fan 4 reduces the input energy requirements since the added on-time of the fan 4 captures the sensible cooling stored in the mass of the indoor coil 2 and the sensible cooling that results from the reevaporation of the water on the coil 2 to reduce the on-time of the compressor 6. Thus, the duration of the energization of the indoor fan 4 is dependent of the humidity level sensed by the humidity sensor 4. In the case of an above setpoint humidity level, the fan 4 is operated for a fixed period of time starting after the energization of the compressor 6 and ending concurrently therewith. Conversely, in the case of a below setpoint humidity level, the energization of the fan 4 is varied in accordance with a sensed humidity level starting with the energization of the compressor 6 and ending at a time after a deenergization of the compressor 6.

Accordingly, it may be seen that there has been provided, in accordance with the present invention, a method for controlling a refrigeration system for reducing off cycle losses during a cooling mode of operation while maintaining a humidity level at or below a desired value and a refrigeration system using this method.

The embodiments of the present invention in which an exclusive property or privilege is claimed are defined as follows:

1. A method for controlling a refrigeration system in a cooling mode of operation having an indoor coil, an indoor coil fan, an outdoor coil, an outdoor coil fan, a refrigerant line between one end of the indoor coil and one end of the outdoor coil, a valve in the refrigerant line and a compressor means connecting the other end of the indoor coil to the other end of the outdoor coil including the steps of sensing a humidity of an indoor space to be cooled by the refrigeration system, and controlling an energization of the indoor coil fan during a time period starting with an energization of the compressor means and ending after the deenergization of the compressor means and having a fan energization duration during said period dependent on the sensed humidity.

2. A method as set forth in claim 1 wherein the duration of the fan energization is a fixed length starting after an energization of the compressor means and ending concurrently with a deenergization of the compressor means for a sensed humidity above a desired humidity level and is a fixed length starting concurrently with an energization of the compressor means and ending at a fixed time after a deenergization of the compressor means for a sensed humidity below a desired humidity level.

3. A method as set forth in claim 1 wherein the duration of the fan energization is a fixed length starting after an energization of the compressor means and ending concurrently with a deenergization of the compressor means for a sensed humidity above a desired humidity level and is a variable length starting concurrently with an energization of the compressor means and ending after a deenergization of the compressor means dependent on the magnitude of a deviation of a sensed humidity below a desired humidity level.

4. A refrigeration system comprising an indoor coil, an indoor coil fan, an outdoor coil, an outdoor coil fan, means for sensing the humidity of an indoor space to be cooled by the system, a refrigerant line connecting one end of said indoor coil to one end of said outdoor coil, compressor means connecting the other end of said indoor coil to the other end of said outdoor coil and controller means for operating the indoor fan, the outdoor fan and the compressor in a sequence for controlling an energization of said indoor fan for a time period starting with an energization of said compressor means and ending after deenergization of said compressor means and having a fan energization duration during said time period dependent on the sensed humidity to maintain an acceptable humidity level.

5. A system as set forth in claim 4 wherein said time period is a fixed time period starting after an energization of said compressor means and ending concurrently with a deenergization of said compressor means for a sensed humidity level above the acceptable humidity level.

6. A system as set forth in claim 4 wherein said time period is a fixed time period having a duration starting with an energization of said compressor means and ending at a fixed time after a deenergization of said compressor means for a sensed humidity level below the acceptable humidity level.

7. A system as set forth in claim 4 wherein said time period is a variable time period having a duration starting with an energization of said compressor means and ending at a time after a deenergization of said compressor means dependent on a sensed humidity level below the acceptable humidity level.

8. A system as set forth in claim 3 wherein said indoor coil is an evaporator and said outdoor coil is a condenser.

* * * * *